United States Patent [19]

Newell

[11] 4,115,082

[45] Sep. 19, 1978

[54] AIR CLEANER ASSEMBLY

[75] Inventor: John Henry Newell, Ancaster, Canada

[73] Assignee: Newtron Co. (Ancaster) Ltd., Ancaster, Canada

[21] Appl. No.: 775,688

[22] Filed: Mar. 9, 1977

Related U.S. Application Data

[63] Continuation of Ser. No. 691,517, Jun. 1, 1976, abandoned.

[30] Foreign Application Priority Data

Mar. 16, 1976 [CA] Canada ..... 248135

[51] Int. Cl.[2] ..... B03C 3/30

[52] U.S. Cl. ..... 55/103; 55/131; 55/485; 55/501; 55/528; 55/DIG. 31; 422/120

[58] Field of Search ..... 55/DIG. 31, 103, 131, 55/316, 482, 485–487, 501, 499, 514, 518, 519, 528; 21/74 R

[56] References Cited

U.S. PATENT DOCUMENTS

| | | | |
|---|---|---|---|
| 2,804,937 | 9/1957 | Poole | 55/103 |
| 3,237,387 | 3/1966 | Haugen et al. | 55/519 |
| 3,461,882 | 8/1969 | Epstein et al. | 55/131 |
| 3,763,633 | 10/1973 | Soltis | 55/131 |

FOREIGN PATENT DOCUMENTS

| | | | |
|---|---|---|---|
| 781,194 | 8/1957 | United Kingdom | 55/499 |
| 1,305,711 | 1/1973 | United Kingdom | 55/316 |
| 1,302,878 | 11/1973 | United Kingdom | 55/487 |

*Primary Examiner*—Bernard Nozick
*Attorney, Agent, or Firm*—Hirons & Rogers

[57] ABSTRACT

An air cleaner assembly of the flow through type has a central element of open cell foam rubber, such as foam polyurethane, two series of rigid thermoplastic rods sandwiching the central element, the rods being capable of developing and holding a positive electrostatic charge, and first and second air permeable outer sheet elements of synthetic fibers, such as polypropylers, overlying each of the series of rods. The assembly has enhanced air cleaning abilities, is readily washable, and produces an atmosphere containing increased concentration of negative ions.

6 Claims, 3 Drawing Figures

AIR CLEANER ASSEMBLY

This is a continuation of application Ser. No. 691,517 filed June 1, 1976, now abandoned.

FIELD OF THE INVENTION

This invention relates to air cleaners of the flow-through type, for use in cleaning gas streams for the removal of suspended particles, especially dust, therefrom. More particularly, it relates to air cleaners of the flow-through type for use with air purifying and air conditioning apparatus.

Commercial flow-through air cleaners for use with air conditioning and circulating apparatus as currently available have somewhat contradictory technical requirements to fulfill. They must be coarse enough to allow air streams to pass through without unduly increasing the power requirements of the unit. At the same time, they must be fine enough or otherwise able to provide efficient filtering of gas streams.

BRIEF DESCRIPTION OF THE PRIOR ART

One type of flow-through air cleaner available commercially consists of two thin layers of a close woven mesh of a synthetic organic resin material, namely polypropylene, and is known as PERMATRON TM. This material is inefficient in its air cleaning abilities, although it is readily cleanable and is relatively air permeable. However, when subjected to fast air flows, the mesh tends to bow outwardly to an excessive extent. Other types of such cleaners have a fibrous media, e.g. of glass fiber or of packed paper, treated with a mineral oil. Whilst such oil treated cleaners are relatively efficient during their initial period of use, they operate by having the suspended dust and dirt particles adhere to the oil with which the cleaner has been treated. After a certain amount of dust and dirt has been removed by adhesion to or absorption by the oil, the dust laden oil becomes detached from the filter medium, with the result that dust laden oil is released into the air stream. Whilst in large scale, sophisticated air conditioning and circulating apparatus, electrostatic precipitators are sometimes employed for air cleaning purposes, they are generally too expensive for general application.

SUMMARY OF THE INVENTION

The present invention provides a novel air cleaner of the flow-through type for use with air conditioning and air circulating systems, which is of improved efficiency for removing dust and dirt particles suspended in the air passing therethrough.

Thus according to the present invention, there is provided an air cleaner assembly of the flow-through type, and comprising:

a central element comprising at least one sheet of rubbery synthetic foam material;

first and second series of rods of thermoplastic material capable of holding a positive electrostatic charge, the first and second series of rods sandwiching the central element therebetween, and contacting the respective outer surface of the central element.

first and second air permeable outer sheet elements of interwoven fibers of synthetic organic resin capable of holding a negative electrostatic charge, said sheet elements being disposed outwardly of the respective first and second series of rods.

DESCRIPTION OF THE PREFERRED EMBODIMENTS

In the preferred embodiment, the central element comprises two sheets of rubbery synthetic open cell foam material disposed mutually parallel and adjacent to one another, with the first and second series of rods contacting outer surfaces of respective ones of the two sheets of foam material. The series of rods are conveniently arranged mutually parallel to one another and extend from side to side across the surfaces of the sheets of foam material. The sheets of foam material may have their inner surfaces in contact with one another, or may be closely spaced from one another.

The central element preferably comprises sheets of an open cell foam material which develops and holds a positive electrostatic charge on flow of air therethrough. A particularly suitable such material is open cell foam polyurethane. Such a material is available commercially. It has the appearance of a fibrous network, is very readily compressible, and has a low resistance to air flow.

The rods (which term is to be understood to include hollow tubular items and solid bar items) are preferably made of a synthetic thermoplastic resin material which develops and holds a positive charge on flow of air therethrough. A suitable such material is acrylic resin. For appearance sake the rods are preferably made of a clear, transparent resin. In addition to contributing to the air cleaning efficiency, they enhance the structural rigidity of the assembly of the invention.

The air permeable sheet elements are preferably of interwoven fibers of polypropylene, in one or more layers. Such fibers develop and hold a negative electrostatic charge on flow of air therethrough. Commercially available sheets of PERMATRON are especially suitable.

The air cleaner assembly according to the invention may conveniently be constructed as a unitary, self-supporting structure, for ease of handling and installation in an air conditioning or air circulating system. For this purpose, the ends of the series of thermoplastic rods may be received in side frame elements. The edges of the outer fibrous sheet elements may also be received in a frame work. These outer fibrous sheet elements and thermoplastic rods and their side frame elements are conveniently of the same shape and surface area, so that the assembly can be received in and held together by means of an outer frame work, so as to form a unitary self-supporting structure.

Preferably, the side frame elements in which the thermoplastic rods are received are of thermoplastic synthetic resinous material which is different from the material from which the rods are made. It is preferred to make the side frame elements from a thermoplastic material which develops no significant electrostatic charge on contact with air flows. A suitable such material is thermoplastic polycarbonate resin.

It has been found that the provision of aforementioned thermoplastic rods capable of holding a positive electrostatic charge arranged with the foam and interwoven fiber sheet elements as described, leads to remarkable and unexpected improvements in air cleaning efficiency of the unit. When air was passed through an air cleaning structure comprising two sheets of open cell polyurethane foam material arranged mutually parallel to an adjacent to one another, overlaid on each side by a sheet of interwoven fibers of polypropylene (PER- MATRON), at a velocity of 1200 ft. per minute, the air cleaner assembly removed 60–65% of the fine dust particles suspended in the air. However, when the air cleaner assembly was modified to include first and second series of mutually parallel acrylic rods, disposed between the central element and PERMATRON layers, and in contact with the outer surfaces of the central element, in accordance with the present invention, about 98% of the suspended fine dust particles were removed, from a similar sample of air at the same flow rate.

This dramatic improvement in air cleaning efficiency is believed due to electrostatic effects. Thus the preferred air cleaner assembly according to the present invention has, in the order in which they contact an air stream flowing therethrough, a polypropylene layer which develops a negative electrostatic charge in use, acrylic rods which develop a positive electrostatic charge in use, first and second foam polyurethane layers which develop a positive electrostatic charge in use, acrylic rods which develop a positive electrostatic charge in use, and finally another polypropylene layer which develops a negative electrostatic charge in use.

In addition to the improved air cleaning efficiency of the assembly of the present invention, it is also found that air which has passed through the assembly has an increased concentration of negative ions. The negative ion concentration in a closed area in which an assembly according to the invention is used with the air circulating apparatus leads to an overall negative charge in the atmosphere of the closed area. A high concentration of negative ions in the atmosphere is understood to be generally beneficial to the health and welfare of persons exposed thereto.

The acrylic rods, which develop a positive electrostatic charge to contribute to the air cleaning efficiency and which are rigid to contribute structural rigidity to the assembly, can be of any suitable cross-sectional shape, such as circular, they may have diameters of from about $\frac{1}{8}$ to $\frac{1}{2}$ inch, dictated largely by the requirement for structural rigidity. The spacing of adjacent acrylic rods of one series does not appear to be critical, provided that they are close enough to confer the necessary structural rigidity to the assembly, and far enough apart not to increase unduly the power requirement for air flow through the assembly. Rods of one series are suitably spaced from one another a distance from about $\frac{1}{2}$ to $1\frac{1}{2}$ inches, preferably about 1 inch. The overall thickness of the air filter assembly according to the present invention is suitably from about $\frac{3}{4}$ to about 2 inches, with a separation of the first series of rods from the second series of rods being about $\frac{1}{2}$ to 1 inch.

DESCRIPTION OF THE DRAWINGS

A specific embodiment of the invention is illustrated in the accompanying drawings, in which.

DETAILED DESCRIPTION OF PREFERRED EMBODIMENT

Figure 1:
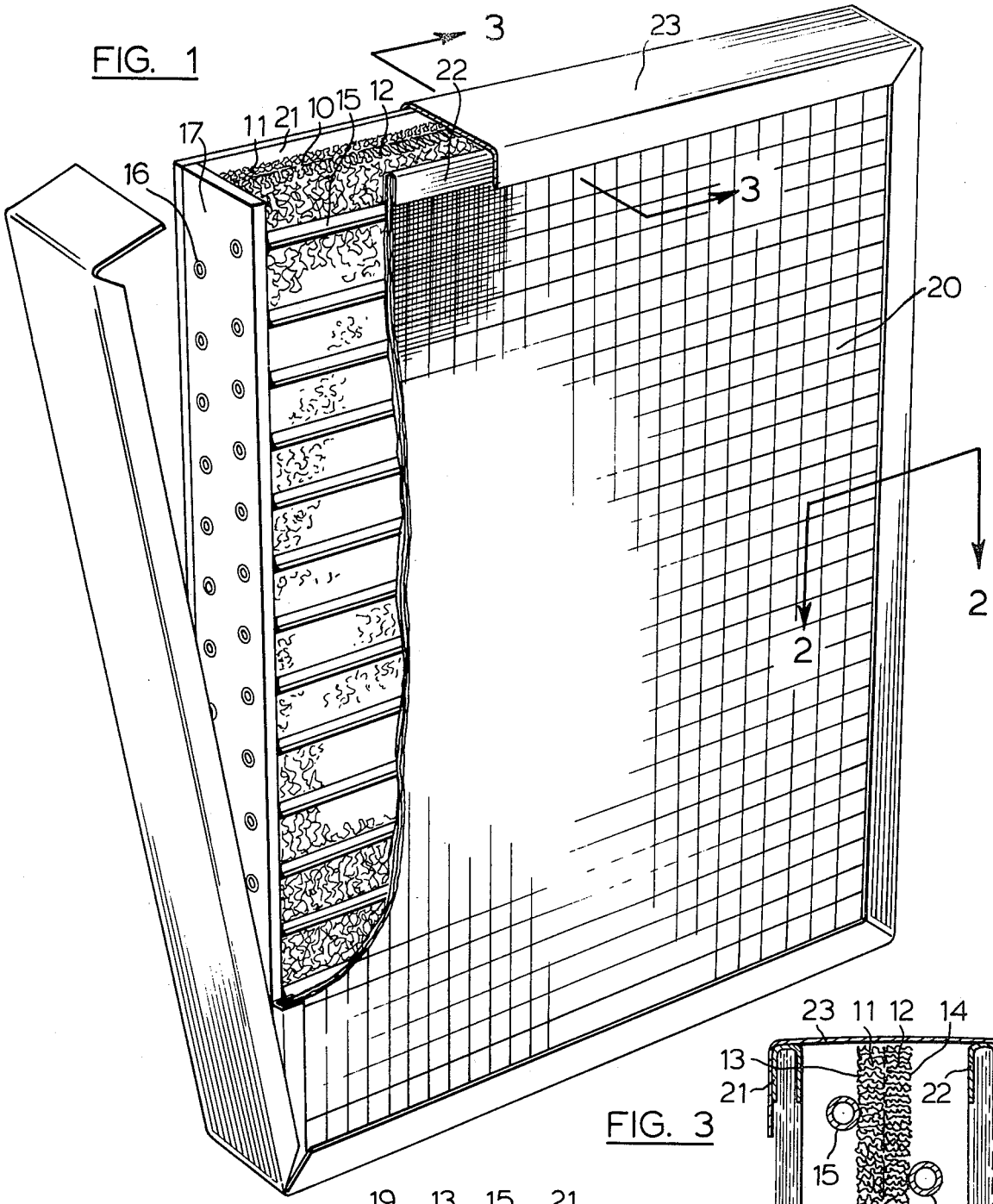
FIG. 1 is a perspective view, partly cut away, of an air cleaner assembly according to the present invention.
Figure 3:
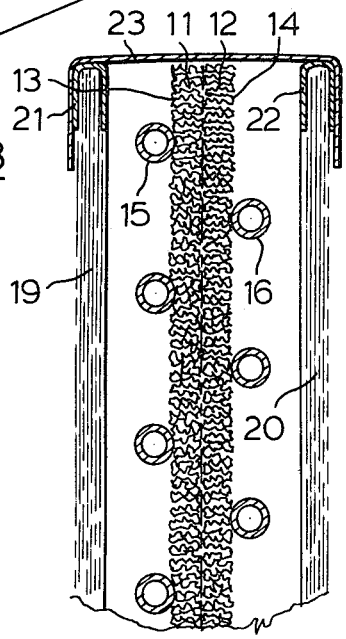
FIG. 3 is a cross sectional view along the line 3—3 of FIG. 1.
Figure 2:
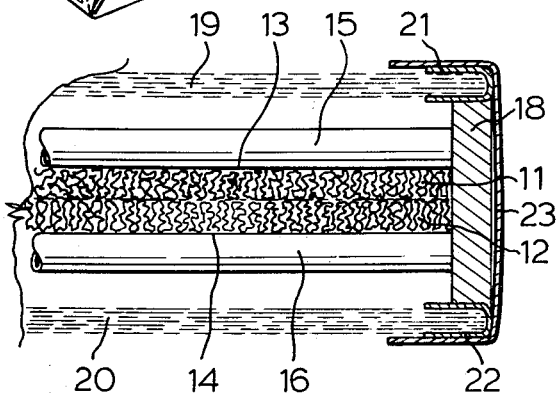
FIG. 2 is a cross sectional view along the line 2—2 of FIG. 1.

In the drawings, like reference numerals indicate like parts.

The air cleaner assembly according to the invention has a central element 10 comprising a first sheet 11 and a second sheet 12 of open cell foam polyurethane material. In appearance, the material is an open cell foam rubber of very coarse nature, in which the rubber is in "fibrous" form, of the nature of a three dimensional honeycomb. The sheets 11, 12 are disposed mutually parallel to one another, with inner surfaces in contact.

In contact with the respective outer surfaces 13, 14 in generally parallel relationship to one another. The spacing between adjacent rods of the first series 15 and of the second series 16 is about 1 inch. At each end the rods are received in respective side frame members 17, 18 of polycarbonate, which also enclose the vertical edges of the sheets 11, 12. The series of rods 15 and 16 are in respective vertical alignment. The side frame members 17, 18 and the rods 15, 16 are secured together by suitable means as shown.

Outwardly of the series of rods 15, 16 are provided respective outer sheets 19, 20 of interwoven fibers of polypropylene, namely PERMATRON. The polypropylene sheets 19, 20 have respective peripheral frameworks 21, 22. The polypropylene sheets 19, 20 and associated peripheral frameworks 21, 22 are of a size and rectangular shape substantially corresponding to that defined by the series of rods 15, 16 and their associated side frame members 17, 18 so that, on assembly, the peripheral frameworks 21, 22 of the polypropylene sheets 19, 20 abut against the edges of the side frame members 17, 18, leaving a space between the rods 15, 16, and the respective polypropylene sheets 19, 20. The assembly is completed by an outer-most framework 23, of generally channel section, fitting around the outer edges of the peripheral frameworks 21, 22 of the polypropylene sheets.

As illustrated, the members of the first series of rods 15 are in staggered relationship to those of the second series 16. This construction as illustrated has been found to provide efficient air purifying, of streams of air passing through from one polypropylene sheet to the other, the suspended particles being primarily collected and deposited in the vicinity of the acrylic rods 15, 16. The air cleaner assembly of the invention, however, does not offer excessive resistance to air flow therethrough, so that the power requirements for a unit with which it is used are not significantly increased.

The assembly according to the invention can be used for extended periods of time for efficient air cleaning. It will not yield up collected dust particles to outgoing air streams unless it becomes effectively clogged with dust or dirt. The assembly is readily removed from its associated power unit, and cleaned with water, on an infrequent periodic basis, without disassembly, by merely hosing it with a water stream. The parts used are simple and cheap to obtain and construct. Individual parts can be replaced and renewed if necessary or desired, without damage to the basic structural elements of the filter assembly. The device can be made in standard sizes as required. It is useful with household and industrial forced air heating furnaces, air conditioners and air circulation apparatus in general.

The efficiency of an air cleaner assembly according to the invention and as illustrated was tested in comparison with other commercially available air cleaners of the flow-through type. To conduct the tests, an unpurified air stream was passed through the air cleaner assembly at a standard velocity, and the air sampled before and after passing through the air cleaner assembly, by means of an air pollution monitoring apparatus containing an ultimate filter. Such a test apparatus is well known, and is used to determine air pollution index. It essentially consists of a box containing a fan, which blows air at the rate of 30 cu. ft. per second through the ultimate filter, for a standard period of time. The ultimate filter is weighed before and after the test, and the pollution index is computed from the difference in weight.

For the purposes of the present tests, the above apparatus was used to sample air before and after passage through air cleaner assemblies. The air before passage through the air cleaner assembly was found to have an air pollution index of about 35. A comparison of the weight increase of the ultimate filters from the air pollution monitoring apparatus when used to test the air before and after its passage through the air cleaner assembly of the invention showed that 98% of the particles suspended in the air had been removed. The test was repeated with a flow-through air cleaner currently on the market known as Airmat Oiled Media (4-ply paper impregnated with oil). This device in similar test conditions removed 78% of the suspended particles. Visual observance of the ultimate filters from the apparatus used to test air after passage through the assembly of the present invention and the Airmat device gave striking evidence of the improved efficiency of the assembly of the invention, even when the incident air stream prior to flowing through the devices had a pollution index as low as 7. The resistance to air flow of the assembly of the present invention (a standard test involving measurements of pressure drop across a flow barrier) was measured and found to be 0.06 wg, highly acceptable figure. In a similar test, the Airmat filter gave a resistance of 0.2 wg. In addition, there is the disadvantage with oil impregnated media that, eventually, the oil will be released and discharged into the air stream.

I claim:

1. An air cleaner assembly of the flow-through type comprising:

a central element comprising two sheets of rubbery synthetic open cell foam polyurethane disposed mutually parallel and adjacent to one another;

first and second series of rods of acrylic plastic, the first and second series of rods sandwiching the central element therebetween, and contacting outer surfaces of respective ones of the two sheets of foam comprising the central element, and extending from side to side across the outer surfaces thereof;

first and second air permeable outer sheet elements of interwoven fibres of polypropylene, said elements being disposed outwardly of the respective first and second series of rods;

thermoplastic side frame members to which the acrylic rods are secured at their edges;

means for assembling said outer sheet elements with said side frame members.

2. The air cleaner assembly of claim 1, wherein the rods of each series are spaced from one another a distance from about ½ to 1½ inches, and the diameters of the rods are from about ⅛ to about ½ inch.

3. The air cleaner assembly of claim 1, wherein the edges of the outer sheet elements of interwoven fibers are received in a peripheral framework which abuts against said side frame elements, and there is provided an outer framework fitting over the pheriphery of the assembled outer sheets and side frame elements, so as to form a unitary self-supporting structure of said filter assembly.

4. The air cleaner assembly of claim 1, wherein said thermoplastic side frame members are of polycarbonate.

5. The air cleaner assembly of claim 4, wherein the rods of said first and second series are mutually parallel to one another.

6. The air cleaner assembly of claim 5, wherein the rods of the first series are staggered with respect to the rods of the second series.

* * * * *